US005372173A

United States Patent [19]

Horner

[11] Patent Number: 5,372,173

[45] Date of Patent: Dec. 13, 1994

[54] WINDOW HAVING MOTORIZED SHADES

[76] Inventor: William P. Horner, R.R. #2 Box 239, Harveys Lake, Pa. 18618

[21] Appl. No.: 100,091

[22] Filed: Jul. 16, 1993

[51] Int. Cl.[5] ..... E06B 3/32

[52] U.S. Cl. ..... 160/98; 160/310

[58] Field of Search ..... 160/98, 310, 311, 312, 160/188

[56] References Cited

U.S. PATENT DOCUMENTS

| | | | |
|---|---|---|---|
| 2,492,721 | 12/1948 | Vita . | |
| 2,606,607 | 8/1952 | Vita . | |
| 3,186,473 | 6/1965 | Myers et al. . | |
| 3,294,152 | 12/1966 | Kuijvenhoven . | |
| 4,649,980 | 3/1987 | Kunz | 160/98 |
| 4,874,026 | 10/1989 | Worrall | 160/310 X |
| 4,974,658 | 12/1990 | Komatsu et al. . | |
| 5,088,543 | 2/1992 | Bilbrey | 160/98 X |
| 5,129,442 | 7/1992 | Warner | 160/310 X |
| 5,139,075 | 8/1992 | Desrochers | 160/310 |
| 5,249,616 | 10/1993 | Yen | 160/98 |

*Primary Examiner*—David M. Purol

*Attorney, Agent, or Firm*—Richard C. Litman

[57] ABSTRACT

A window shade located between the two window panes of a window is automatically driven by two electric motors attached to the roller of the window shade so as to place the window shade in a raised position or a lowered position in accordance with the polarity of the power supplied to two electric motors. A relay, when activated, provides power to a manually activated switch having two positions to control the polarity of the power supplied to the electric motors. When deactivated, the relay bypasses the manually activated switch and provides power to the electric motors having a polarity to place the window shade in its lowered position.

6 Claims, 2 Drawing Sheets

WINDOW HAVING MOTORIZED SHADES

BACKGROUND OF THE INVENTION

1. Field of the Invention

The present invention relates to window shades having a roller driven by an electric motor. More particularly, the present for invention pertains to the use of window shades used in booths viewing X-rated performances; in which the window shades are driven up upon payment of a fee and the activation of a switch by the user and remain up for a predetermined period of time thereafter.

2. Description of the Prior Art

Reversible electric motors have been used to allow a user to raise and lower shades through the use of a switch so as to eliminate the need of the user having to reach up to pull the shades down or having to pull on the shades in order to raise the shades. The switch is generally provided in the vicinity of the window and provides power to the motor in one direction to raise the shades and in another direction to lower the shades.

U.S. Pat. No. 2,492,721 issued Dec. 27, 1949 and U.S. Pat. No. 2,606,607 issued Aug. 12, 1952, both to Lawrence Vita, disclose windows having electric motors for lowering a window glass below the window sill so as to place a window screen in the window opening. When the motors are reversed, the window screen is rolled up on a roller, raising the window glass into the window opening.

U.S. Pat. No. 4,974,658 issued Dec. 4, 1990 to Komatsu et al. discloses a sheet shutter raised and lowered by a motor and having both an upper and lowlier limit switches.

U.S. Pat. No. 3,186,473 issued Jun. 1, 1965 to D. E. Myers et al. discloses shades having various designs thereon for allowing various amounts of light into the room. An electric motor winds the shades up on a lower roller as shades are being unwound from an upper roller. In this manner various amounts of light may be allowed into the room.

U.S. Pat. No. 3,294,152 issued Dec. 27, 1966 discloses a motorized shade in which a photosensor detects the amount of light in the room and automatically causes the shades to be further lowered or raised to vary the amount of sunlight in the room in accordance with a comparison of the amount of light detected by the photosensor and a predetermined threshold value.

None of the above inventions and patents, taken either singly or in combination, is seen to describe the instant invention as claimed.

SUMMARY OF THE INVENTION

The window of the present invention using motorized shades allows a user to view through a window for a predetermined duration of time after the initial activation of a timer switch. A manually activated rocker switch in the vicinity of the window allows a user to raise the window shades when placed in a first position by the user and to lower the window shades when placed in a second position. A relay will cause the window shade to lower automatically after the predetermined duration of time has elapsed even if the manually activated rocker switch is in its first position.

The window of the present invention is for use in X-rated movie booths. It is to be installed on the con,-non wall between two movie booths, one unit: on each side. Each unit is independent of the other. When the customer deposits money or tokens to turn on the movie, it turns on an indicator light above the door to the booth. All video systems use this method to indicate the booth is occupied. The timer switch Of the present invention is responsive to the insertion of coins or tokens into the device of the present invention. As stated above, upon expiration of the duration of time set by the timer switch, the shades are driven down irrespective of the set position of the manually activated rocker switch.

The window of the present device includes two quarter inch thick safety glass window panes having a gap located therebetween in which the shade, preferably a polyethylene shade, is allowed to travel up and down. The shade has a vinyl guide attached at the bottom thereof which travels within a quarter inch thick aluminum track located within the gap. At the top of the frame of the window is a compartment housing a roller onto which the shade is wound. At both ends of the roller a pulley is located. Above each pulley is located a motor having a pulley attached thereto. A pulley belt is located between the pulley of each motor and the pulley located at the end of the roller directly below the motor driving that end of the roller. All control circuitry used for controlling the two reversible electric motors is also located in the compartment of the window, except for two limit switches used to stop the motors after the vinyl guide has been driven to a maximum upward location or a minimum downward location.

Accordingly, it is a principal object of the invention to provide a window having motorized shades responsive to a manually activated switch and a timer circuit.

It is another object of the invention to provide such a window in which the shades are drawn down automatically after a predetermined duration of ::time has expired from the initial activation of the timer switch, irrespective of the position of the manually activate switch.

It is a further object of the invention to provide two glass panes with a gap therebetween for allowing the shades to travel up and down therein.

Still another object of the invention is to provide limit switches to stop the motors upon opening the shades completely or closing the shades completely.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
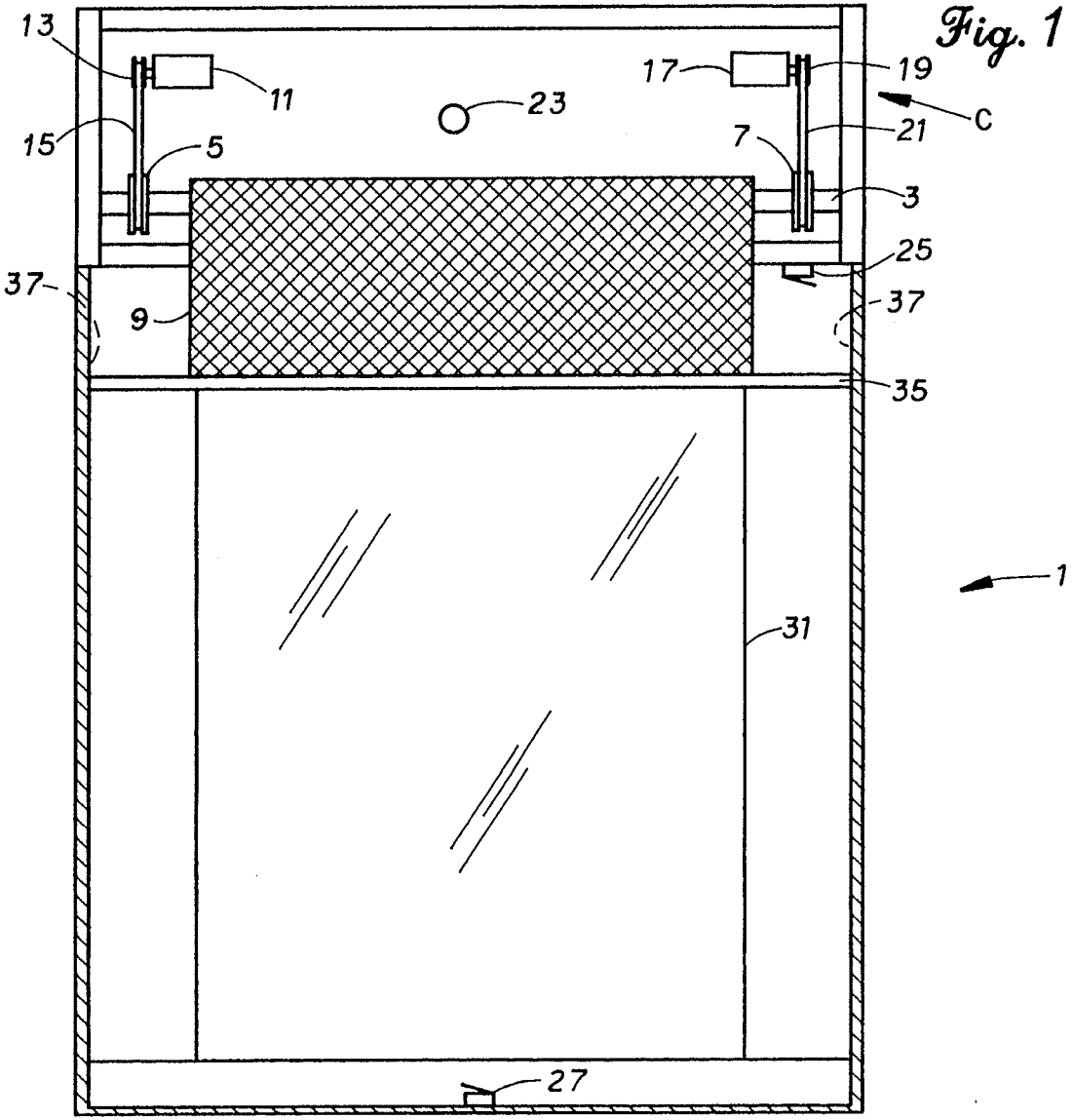
FIG. 1 is a front view of the present invention having a partial cutaway view.

As shown in FIG. 1, the window 1 of the present invention includes a roller 3 having a right roller pulley 5 located on a right end portion of the roller 3 and a left roller pulley 7 located on a left end portion of the roller 3. A shade 9 has a portion thereof located around a middle portion of the roller 3 located between the right and left ends thereof. Located above the right roller pulley 5 is a right side motor 11 having a right motor pulley 13 attached thereto. A right side pulley belt 15 engages the right roller pulley 5 and the right motor pulley 13 so as to allow the right side motor 1]to rotate the roller 3. In the same manner, a left side motor 17, having a left motor pulley 19 attached thereto rotates the roller 3 through the use of a left side pulley belt 21 engaging both the left motor pulley and the left roller pulley 7. Control circuitry, not shown in FIG. 1, synchronously drives both the right side motor 11 and the left side motor 17 so that they both rotate the roller 3 in the same direction and speed at any given time. A manually activated switch 23 is part of the control circuitry and allows the user to indicate whether he or she desires the shade 9 to be raised or lowered. An upper limit switch 25 and a lower limit switch 27 are used to stop the motors 11 and 17 when the shade 9 is completely raised or lowered, respectively. The roller 3, pulleys 5, 3, and 19, and the motors 11 and 17 as well as the manually activated switch 23 and the control circuitry are all located in a compartment C located in a top portion of the window 1.

Figure 2:
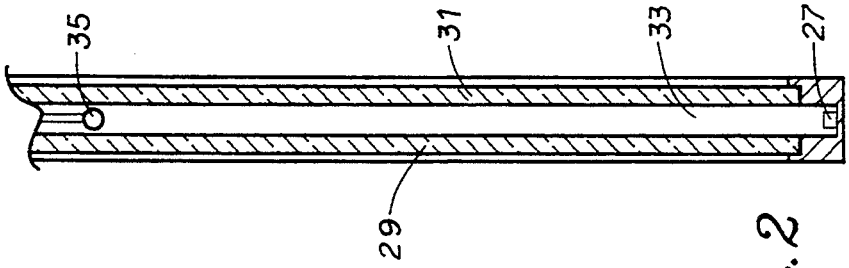
FIG. 2 is a cutaway partial side view of the present invention.

As shown in FIG. 2, a first window pane 29 is located in the front of the window I and a second window pane 31 is located in the back of the window 1. A gap 33 is located between the window panes 29 and 31. The shade 9 is located within this gap 33 and includes a vinyl guide 35 attached at the end thereof. The guide 35 has both of its far ends located in tracks 37. As the shade 9 is completely lowered, the guide 35 opens the lower limit switch 27 causing power supplied to the electric motors 11 and 17 to be cut. Likewise, as the shade 9 is completely raised, the guide 35 opens the upper limit switch 25 so as to cut the power supplied to the electric motors 11 and 17 as the shade 9 is completely raised.

Figure 3:
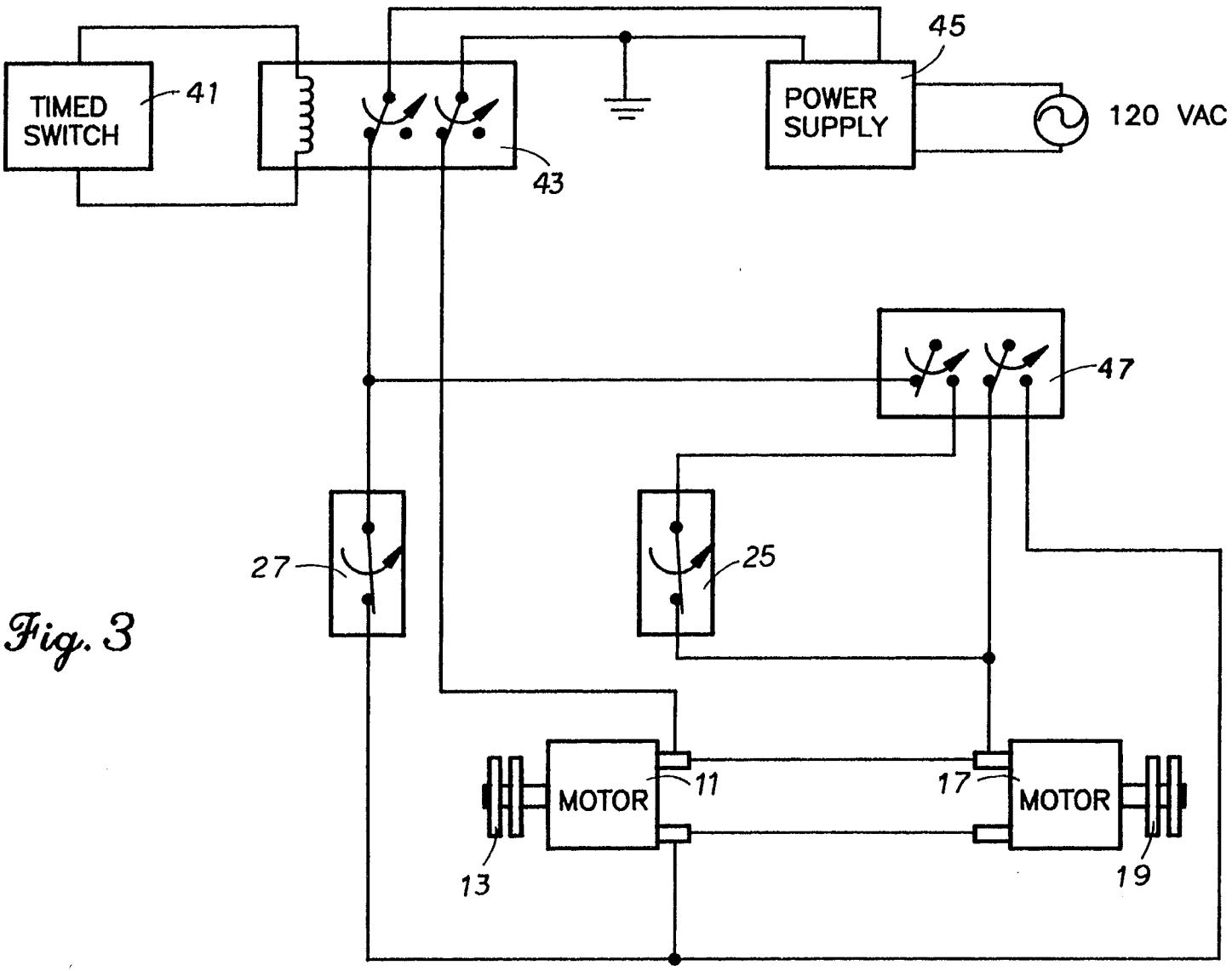
FIG. 3 is a schematic diagram of the control circuitry of the present invention used to drive the shades up and down.

The control circuitry for the window I is illustrated in FIG. 3. A timed switch 41 is used to activate a relay 43 so as to allow power from a power supply 45 connected to regular household current to be supplied to a switch 47. The output of the power supply is preferably around three (3) volts DC. The switch 47 is shown in its second position for lowering the shade 3. When the switch 47 is placed in its first position, the polarity supplied to the motors 11 and 17 is reversed, so as to drive both of the motors 11 and 17 in a rotational direction so as to raise the shades 3. As soon as the guide 35 engages the upper limit switch 25, power is no longer supplied to the motors 11 and 17, and the shades stop rising.

As illustrated in FIG. 3, power is only supplied to the relay 43 upon activation thereof by a timed switch 41. The timed switch 41 is activated for a predetermined time duration after a predetermined amount of money is deposited therein. The timed switch 41 is part of any conventional coin detect mechanism as used in commercial washing machines and dryers. When the relay 43 is deactivated or when the manually activated switch is located in its second position, the polarity of the power supplied to the motors 11 and 17 causes the shades to be lowered until the guide 35 engages the lower limit switch 27 so as to open the switch 27 and cut the power supplied to the motors 11 and 17.

It is to be understood that the present invention is not limited to the sole embodiment described above, but encompasses any and all embodiments within the scope of the following claims.

I claim:

1. A window including:

a first window pane located in the front of the window;

a second window pane located in the back of the window;

a gap located between said first and second window panes;

a roller located in an upper compartment of said window, said roller including a left end portion, a right end portion, and a middle portion located between said left end portion and said right end portion;

a window shade having at least a minimal portion thereof wrapped around said middle portion of said roller, said shade including a guide located at the end thereof, said guide being located within said gap;

a left roller pulley located on said left end portion of said roller;

a right roller pulley located on said right end portion of said roller;

a right side motor located above said right roller pulley within said compartment, said right side motor including a right motor pulley attached to a drive shaft of said right side motor;

a left side motor located above said left roller pulley within said compartment, said left side motor including a left motor pulley attached to a drive shaft of said left side motor;

a right side pulley belt engaging said right roller pulley and said right motor pulley;

a left side pulley belt engaging said left roller pulley and said left motor pulley; and control circuitry located within said compartment for synchronously controlling both said right and left side motors.

2. The window according to claim 1, wherein said control circuitry includes a manually activated switch having a first position thereof for allowing power supplied thereto to drive both said right and left side motors so as to place said window shades in a raised position in which said window shade includes a maximum portion thereof wrapped around said middle portion of said roller, said manually activated switch including a second position thereof for allowing power supplied thereto to drive both said right and left side motors so as to place said window shades in a lowered position in which said window shade includes said minimal portion thereof wrapped around said middle portion of said roller, wherein said guide is located in a maximum raised position when said window shades are located in their raised position, and said guide is located in a minimum lowered position when said window shades are located in their lowered position.

3. A window as claimed in claim 2, wherein said control circuitry further includes a relay for supplying power to said manually activated switch when said relay is activated, and for driving both said right and left side motors so as to place said window shades in said lowered position.

4. A window as claimed in claim 3, wherein said control circuitry further includes a timer switch for activating said relay for a predetermined time duration after a detection of a predetermined amount of money being inserted within a coin slot thereof.

5. A window as claimed in claim 3, wherein said control circuitry further includes a normally closed upper limit switch for stopping both said right and left side motors when said window shade is located in its raised position, said upper limit switch being located within said window so as to engage said guide when said guide is located in its maximum raised position so as to open said limit switch.

6. A window as claimed in claim 3, wherein said control circuitry further includes a normally closed lower limit switch for stopping both said right and left side motors when said window shade is located in its lowered position, said lower limit switch being located within said window so as to engage said guide when said guide is located in its minimum lowered position so as to open said limit switch.

* * * * *